United States Patent [19]

Schwartz

[11] 4,209,286

[45] Jun. 24, 1980

[54] SELF LUBRICATING VANE FOR A ROTARY VANE COOLING SYSTEM

[76] Inventor: Kenneth P. Schwartz, 2604 N. Emerald, Fairborn, Ohio 45324

[21] Appl. No.: 946,289

[22] Filed: Sep. 27, 1978

[51] Int. Cl.[2] ..... F01C 13/00; F01C 21/00

[52] U.S. Cl. ..... 418/13; 418/152; 418/178; 418/260

[58] Field of Search ..... 418/152, 178, 260, 13

[56] References Cited

U.S. PATENT DOCUMENTS

| | | | |
|---|---|---|---|
| Re. 24,932 | 1/1961 | Davey | 418/152 |
| 3,552,895 | 1/1971 | Bayley | 418/178 |
| 4,088,426 | 5/1978 | Edwards | 418/260 |

FOREIGN PATENT DOCUMENTS

| | | | |
|---|---|---|---|
| 2416510 | 10/1975 | Fed. Rep. of Germany | 418/152 |
| 2600972 | 3/1977 | Fed. Rep. of Germany | 418/178 |
| 43-20204 | 7/1968 | Japan | 418/178 |
| 795204 | 5/1958 | United Kingdom | 418/152 |
| 1324443 | 7/1973 | United Kingdom | 418/152 |

*Primary Examiner*—John J. Vrablik

*Attorney, Agent, or Firm*—Joseph E. Rusz; Richard J. Killoren

[57] ABSTRACT

A reverse Brayton cycle rotary vane cooling system having a compressor and an expander driven by a common shaft. The vanes which slide in slots in a rotor are actuated by cams and cam rollers. The vanes are constructed with high modulus of electricity fibers in an epoxy resin binder. The outer wear surface of the vanes contain a material with self lubricating properties.

3 Claims, 5 Drawing Figures

SELF LUBRICATING VANE FOR A ROTARY VANE COOLING SYSTEM

RIGHTS OF THE GOVERNMENT

The invention described herein may be manufactured and used by or for Government of the United States for all governmental purposes without the payment of any royalty.

BACKGROUND OF THE INVENTION

This invention relates to a vane for use in a rotary vane reverse Brayton cycle cooling system.

The patents to Edwards, U.S. Pat. Nos. 3,686,893; 3,886,765; 3,913,351; 3,956,904; 3,977,852 and 4,088,426, describe cooling systems which operate on the reverse Brayton cycle.

In conventional rotary vane cooling systems wherein the vanes slide in slots in a rotor, vane actuation is achieved either by contact forces between the vane tips and the chamber wall or by the use of cams and cam rollers positioned at the two ends of the sliding vanes.

Vane actuation achieved by contact forces between the vane tips and the chamber wall results in increased vane tip friction and wear. Vane actuation by cams and cam rollers at the end of the vanes can result in excessive vane deflections with increased wear. High strength vane materials which reduce vane deflections have poor wear characteristics and result in excessive wear in the slots.

BRIEF SUMMARY OF THE INVENTION

According to this invention vanes for use in reverse Brayton cycle cooling apparatus are constructed with high modulus of electricity fibers molded into a binding material such as an epoxy resin. The wear surfaces of the vanes include a material with self lubricating properties.

IN THE DRAWING

DETAILED DESCRIPTION OF THE INVENTION

Figure 1:
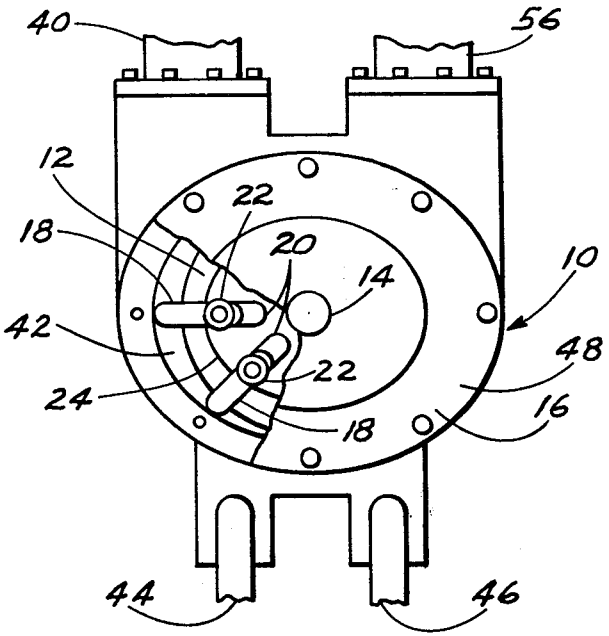
FIG. 1 is a partially schematic partially cut away view of a conventional reverse Brayton cycle rotary sliding vane cooling system with which the vanes of the invention could be used.
Figure 2:
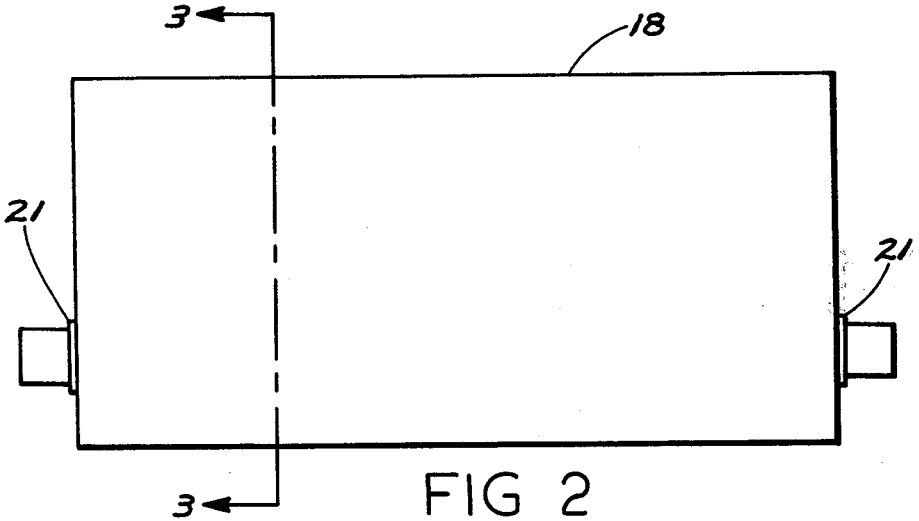
FIG. 2 is an enlarged side view of a vane such as used in the device of FIG. 1, according to the invention.

Reference is now made to FIG. 1 of the drawing which shows a rotary vane gas cycle cooling system 10 having a rotor 12 on a shaft 14 within housing 16. The rotor 12 includes a plurality of vanes 18 which slide in slots 20, as in a conventional rotary vane cooling system. The vanes 18 have bearing supports 21 which are journalled into bearings 22 which ride on vane guide cams 24.

Figure 3:
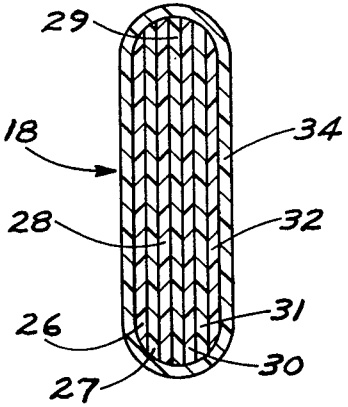
FIG. 3 is a schematic sectional view of the device of FIG. 2 along the line 3—3.

The vanes are made of a plurality of layers of high modulus elasticity fibers such as carbon fibers, boron fibers or Kevlar fibers. The fibers are molded into an epoxy resin. While these composite blades would not have individual layers of material after curing, the separate layers and epoxy resin are shown schematically at 26, 27, 28, 29, 30, 31 and 32 in FIG. 3. The orientation of the fibers in certain layers would be different than the orientation of fibers in certain other layers. One distribution of fiber orientations which could be used are shown at *26a*, *27a*, *28a*, *29a*, *30a*, *31a* and *32a* in FIG. 4. The layers could be individually impregnated with epoxy resin and partially cured, with cutout regions 33 provided to receive bearing supports 21, with the layers being bonded together around the inserts in a final curing operation or fibers could be made up in sheets and covered with binding material as each sheet is laid in a mold and then molded around the inserts in a single curing operation. The outer layer indicated schematically at 34 is made of a material with self lubricating properties.

Figure 4:
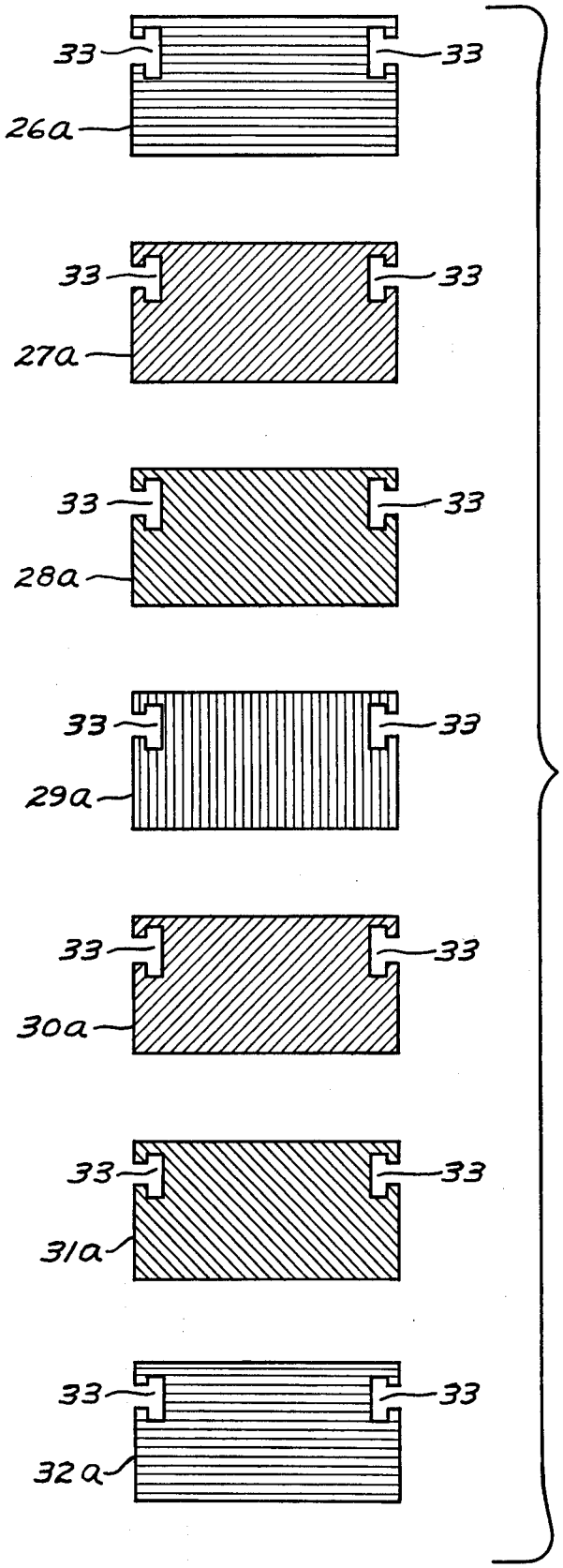
FIG. 4 is a schematic illustration showing fiber orientation such as could be used in the device of FIGS. 2 and 3.
Figure 5:
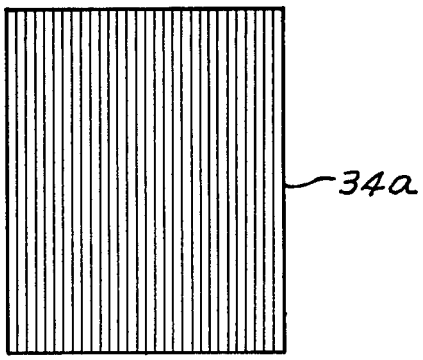
FIG. 5 is a schematic illustration showing fiber orientation as could be used in the surface region in the device of FIGS. 2 and 3.

The surface region 34 of the vanes could be made with polytetrafluoroethylene fibers in an epoxy resin binder with an orientation, as shown at *34a* in FIG. 5, which orientation would correspond to the radial orientation of the fibers shown at *29a* in FIG. 4. The surface region 34 could also be made with glass, boron or Kevlar fibers with a self lubricating material such as polytetrafluoroethylene powder or molybdenum-disulfide particles added to the epoxy resin binder. The use of carbon fibers in the surface region of the vanes would be undesirable for apparatus requiring long service life, such as in space applications, due to the corrosive properties of carbon.

Binder material other than epoxy resins could be used; for example, it may be desirable to use polyimid binders or other binders used in composite structures for some applications.

In the operation of the device a gas, such as air, from inlet 40 is compressed in compressor 42 and passes through outlet 44 to a conventional cooling heat exchanger, not shown. The gas from the cooling heat exchanger enters inlet 46 and is expanded in the expander portion 48 of the rotary vane cooling system. The expanded gas passes from outlet 56 to an environmental control heat exchanger, not shown, as in a conventional reverse Brayton cycle rotary vane cooling system. The composite structure reduces vane deflection and bearing wear. The self lubricating outer surface of the vanes reduce wear of the vanes and slots.

There is thus provided a reverse Brayton cycle cooling system with improved bearing wear properties and reduced vane and slot wear characteristics.

I claim:

1. In a reverse Brayton cycle rotary vane cooling system having a plurality of vanes positioned in slots in a rotor within a housing with vane guide cam surfaces within the housing adjacent the ends of the rotor and cam bearing members supported on said vanes and being positioned in cam engaging relation to said vane guide cam surfaces, vane structure for said vanes comprising: a plurality of layers of high modulus of elasticity fibers molded into a binding material with the orientation of the fibers in each layer being different than the orientation of the fibers in adjacent layers with a central layer of fibers being positioned with a radial orientation; bearing supports, for said bearing members, molded into opposite ends of the vanes; a self lubricating layer of non-corrosive materials surrounding the vanes and covering the wear surface regions of the vanes; said layer covering the wear surfaces of the vanes including fibers having portions extending radially on opposite sides of the vanes and portions extending over the inner and outer edges of the vanes.

2. The device as recited in claim 1 wherein said high modulus of elasticity fibers are carbon fibers and said fibers in the self lubricating layer are polytetrafluoroethylene fibers in an epoxy resin binder.

3. The device as recited in claim 1 wherein said fibers are boron fibers and said fibers in the self lubricating layer are polytetrafluoroethylene fibers in an epoxy resin binder.

* * * * *